United States Patent [19]

Kitazawa et al.

[11] 3,949,544

[45] Apr. 13, 1976

[54] PROCESS FOR PRODUCING HIGH BULKY YARN BY FALSE-TWISTING SYSTEM

[75] Inventors: Shin-ich Kitazawa, Kyoto; Takao Negishi; Kozo Susami, both of Otsu, all of Japan

[73] Assignee: Toray Industries, Inc., Tokyo, Japan

[22] Filed: Oct. 15, 1974

[21] Appl. No.: 514,552

Related U.S. Application Data

[63] Continuation of Ser. No. 239,462, March 30, 1972, abandoned.

[30] Foreign Application Priority Data

June 17, 1971 Japan ..... 46-42974

[52] U.S. Cl. ..... 57/157 TS; 57/34 HS; 57/140 BY

[51] Int. Cl.[2] ..... D02G 1/02; D02G 3/04

[58] Field of Search ..... 57/34 HS, 140 R, 140 BY, 57/157 TS; 28/62

[56] References Cited

UNITED STATES PATENTS

| | | | |
|---|---|---|---|
| 3,067,563 | 12/1962 | Van Dijk | 28/62 X |
| 3,745,757 | 7/1973 | Selwood | 57/157 TS X |
| 3,762,148 | 10/1973 | Thrower, Jr. | 57/157 TS X |
| 3,775,959 | 12/1973 | Bond | 57/157 TS X |
| 3,828,542 | 8/1974 | Boutonnet et al. | 51/157 TS X |

*Primary Examiner*—Richard C. Queisser
*Assistant Examiner*—Charles Gorenstein
*Attorney, Agent, or Firm*—Burgess Ryan and Wayne

[57] ABSTRACT

A fibrous strand including at least some short fibers and composed of two or more kinds of fibers of different melting point temperatures is, concurrently with false twisting, and in a vibrating condition, heated by a heater of the non-contact type at temperatures between the highest and lowest melting point temperatures of the component fibers so as to produce spun-like yarns of a substantially twistless configuration containing uniformly scattered points of inter-fiber binding and fibers crimped in the form of a coil.

4 Claims, 8 Drawing Figures

PROCESS FOR PRODUCING HIGH BULKY YARN BY FALSE-TWISTING SYSTEM

Figure 1:
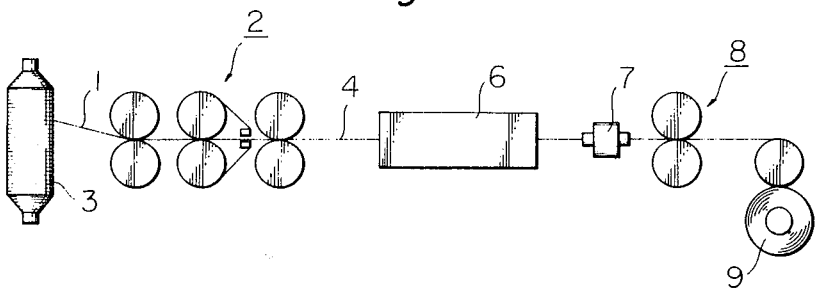

This is a continuation of application Ser. No. 239,462, filed Mar. 30, 1972, now abandoned.

The present invention relates to a process and apparatus for producing spun-like yarns by a false-twisting system, more particularly this invention relates to a process and apparatus for producing spun-like yarns of substantially twistless configuration from a fibrous strand composed of fibers having different melting point temperatures by the application of heat during the false-twisting operation.

As a technique for producing spun-like yarns, the art of false-twisting of fibrous strands issuing from spinning machines is known to persons skilled in the art. In this connection, the conventional false-twisting processes are roughly classified into two groups.

In the false-twisting process of the first group, a fibrous strand issuing from the spinning machine is composed of a fibrous component having a high melting-point temperature and a fibrous component having a low melting-point temperature. In this case, the first-mentioned component neither melts nor decomposes at the melting-point temperature of the second-mentioned component. After the issue from the spinning machine, the fibrous strand is subjected to the false-twisting action under heat at temperatures whereat the second-mentioned component melts so as to bind the first-mentioned component fibers to each other. After this false-twisting action under heat, the fibrous strand is wound up in the usual manner in a substntially twistless condition.

Although the process of the above-described type has its own merits, it is accompanied by serious drawbacks as hereinafter described, especially in the actual practice of the process. In this process, the fibrous strand is heated during the false-twisting. For this purpose, especially when a fibrous strand of a relatively large thickness has to be processed at high speed, it is necessary to provide a long heater surface. Further, for high efficiency in the heating, the fibrous strand is generally processed while in direct contact with the heater surface during the heating. The thicker the fibrous strand, the longer the heater surface. This direct running contact of the fibrous strand with the long heater surface considerably hinders the smooth propagation of the twists along the fibrous strand and the twists imparted by the false-twisting spindle do not smoothly develop to the strand portion near the front rollers nip. This poor twist impartation results in the production of a fibrous strand in a less twisted disposition which then comes into running contact with the heater surface and the fibrous component of the low melting point temperature tends to adhere to the heater surface in a fused condition. The above-mentioned poor twist impartation and thermal fusion of the fibrous material to the heater surface tends to cause frequent breakages of the fibrous strand during the processing and, partly due to such breakages of the strand, the quality of the yarn produced is considerably degraded.

In the case of the false-twisting process of the second group, adhesive agents in the liquid state are applied to the fibrous strand concurrently with the false-twisting action and the adhesive agents are solidified by a subsequent heating action before the winding up action in the usual way.

This process also is accompanied by drawbacks as hereinafter described. Because the adhesive agent or agents are brought into contact with the fibrous strand in the liquid state, the solvent or solvents used must be removed from the strand in a later stage of the operation and such essential removal of the solvent requires corresponding provision of arrangement(s) for such a removal. Further, the necessary drying of the adhesive agent(s) tends to limit the processing speed of the strand so treated. In the process of this type, the heating must be performed without direct contact of the fibrous strand with the heater surface. Such indirect heating causes lowering of the heating efficiency and troublesome handling of the strand during the processing. When the adhesive agent(s) are applied to the strand in the liquid state, the binding of the component fibers takes place along the entire length of the fibers resulting in increased restriction of the free movement of the component fibers in the end products. Such restricted movement of the component fibers brings about a degraded appearance, poor hand and poor stretchability of the products obtained.

The object of the present invention is to provide a process and apparatus for producing spun-like yarn of a substantially twistless configuration but having excellent coherency by a false-twisting system while eliminating the drawbacks encountered in the prior art of similar systems.

In the art of the present invention, first a fibrous strand containing at least some short fibers is prepared from two or more kinds of fibers having different melting point temperatures. The fibrous strand so prepared is processed through a heater of the non-contact type in a vibrating condition before arrival at the false-twisting spindle, which heater has a heater surface spacedly facing the running fibrous strand and has a temperature between the highest and the lowest melting point temperatures of the component fibers.

Figure 2:
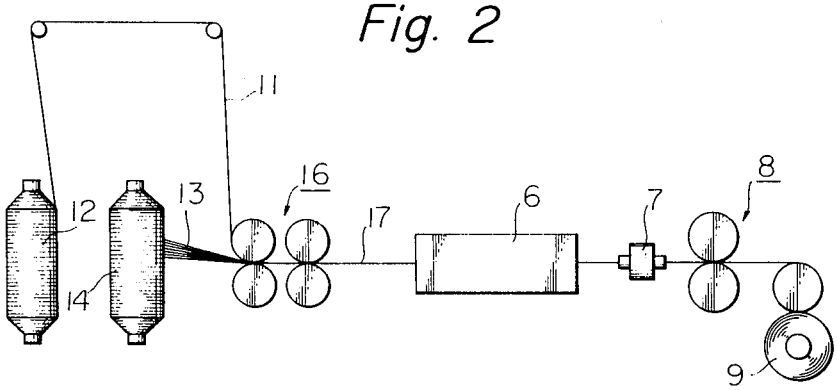
Figure 3A:
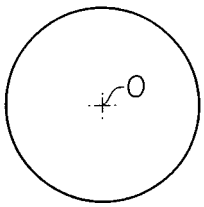
Figure 3B:
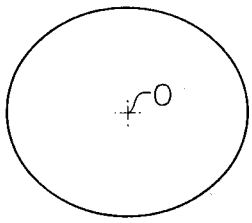
Figure 3C:
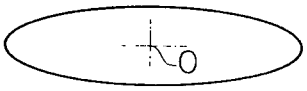
Figure 3D:
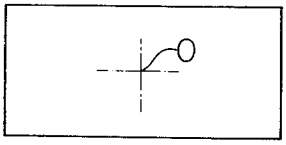
Figure 4:
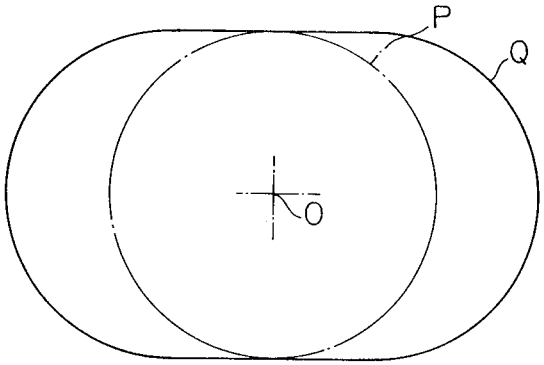
Figure 5:
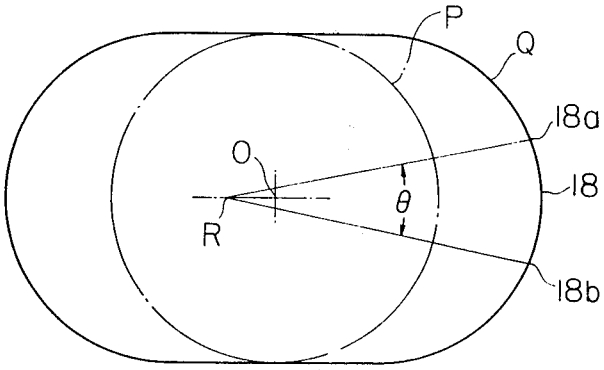

Further features and advantages of the present invention will be made clear in the following description, reference being made to the accompanying drawings, wherein;

FIG. 1 is a schematic sketch of one embodiment of the apparatus of the present invention, FIG. 2 is a schematic sketch of another embodiment of the apparatus of the present invention, FIGS. 3A to 3D are schematic sketches for showing various transverse profiles of the heater surface of the heater used in the apparatus of the present invention, FIGS. 4 and 5 are schematic sketches for explaining the dimension of the heater surface of the heater used in the apparatus of the present invention.

Referring to FIG. 1, an embodiment of the arrangement for carrying out the method of the present invention is illustrated. In the arrangement, a roving 1 which is made up of fibers of different melting point temperatures and including, at least some short fibers is fed to a draft zone 2 from a supply bobbin 3. In the case of the example shown, a draft zone of the so-called three lines type including apron rollers is used. After completion of the drafting, the drafted fibrous strand 4 is advanced through a heater 6 of the non-contact type and is false twisted by a false-twisting spindle 7. Subsequent to the false-twisting, the fibrous strand 4 is taken up by take-up rollers 8 and wound on a take-up package 9. The fibrous strand 4 is advanced through the heater 6 in a vibrating condition, the vibration being caused by the ballooning due to the high speed false-twisting action of the spindle 7.

Another embodiment of the arrangement for carrying out the method of the present invention is illustrated in FIG. 2, wherein a multifilamentary yarn 11 from a supply bobbin 12 is consolidated with a sliver 13 of spun fibers from a separate supply bobbin 14 when they are introduced into a draft zone 16 of the so-called two lines type. The spun fibers composing the sliver 13 are different from the filaments composing the yarn 11 in the melting point temperature. After drafting, the consolidated fibrous strand 17 is heated by the heater 6, false twisted by the spindle 7, taken up by the take-up rollers 8 and wound up onto the take-up package 9. During the travel through the heater 6, the fibrous strand 17 is placed in a vibrating disposition due to the ballooning caused by the high speed false-twisting action of the spindle 7.

As briefly mentioned above, the material fibrous strand to be subjected to the process of the present invention should be made up of two or more kinds of fibers of different melting point temperatures and, further, should contain, at least partly, a certain amount of short fibers such as spun fibers. Such fibers as polyesters, polyamides, polypropylene, rayon, acetate, silk and wool can be used in suitably designed combination. This combination should be so designed that at least one kind of fiber can be given coil-shaped crimps by the false-twisting operation. For example, a combination of polyester fibers containing 5 to 20 percent by weight of polypropylene fibers is favourably used in the process of the present invention, the heating temperature by the heater 6 ranging from 110° to 180°C. That is, the heating is carried out at temperatures so that no melting of the polyester fibers takes place.

It is also necessary that the material fibrous strand should contain at least some short fibers. For example, the material fibrous strand may be composed of two or more kinds of short fibers of different melting point temperatures. The fibrous strand may be provided in the form of a filamentary yarn or yarns doubled with one or more short fiber strands, the melting point temperature of the former being different from that of the latter. Further, filamentary yarns of different melting point temperatures may be combined with one or more short fiber strands.

The material fibrous strand so prepared must be subjected to heating by the heater 6 of the non-contact type. This heating must be carried out at temperatures so that at least one kind of fibers of low melting point temperature melt but the fibers of the highest melting point temperature do not melt at all. By the melting of the fibers of low melting point temperature(s), the remaining non-melted fibers are bound to each other at random points. This binding by melting takes place uniformly at every point of contact within the configuration of the material fibrous strand resulting in the building of uniformly scattered points of inter-fiber binding. Owing to the presence of such inter-fiber binding points, the yarn so produced is provided with a desirable bulkiness caused by the false-twisting together with stable internal configuration caused by this binding by melting.

For the heating of the fibrous strand according to the present invention, a heater 6 of the non-contact type is used. This non-contact type heater is desirably so constructed that the heater surface spacedly surrounds the running fibrous strand so that the strand is uniformly heated from outside. In this sense, an internally hollow heater is desirably used for the heating purpose. Because the strand does not contact the heater surface directly, the heater surface is not soiled by the molten fibers of low melting point temperature(s) and the falling of fibers from their associated fibrous strand can be minimized. Further, non-contact of the fibrous strand with the heater surface assures enhanced development of the twists along the strand during the false-twisting operation. A further detailed explanation of the design of such heater will be given in the later part of this specification.

It is another important feature of the present invention that the fibrous strand passes through the heater in a vibrating condition. Provision of such vibration to the fibrous strand is effected by utilizing the ballooning of the strand caused by the high speed false-twisting action of the spindle 7 or by equipping the heater with a suitable vibrator mechanism for compulsively vibrating the fibrous strand, such mechanism being located near the inlet or outlet terminal of the heater 6. The fibrous strand may be vibrated either vertically or horizontally. If ballooning is utilized for this purpose, false-twist spindles of relatively large diameter are desirably used so as to result in the ballooning of larger extent.

After heating, the strand is successively subjected to the false-twisting operation, which is carried out using conventional spindles of the peg-type, friction type or pneumatic vortex type. Among these, spindles of the inside contact type and pneumatic vortex type are desirably employed.

In the case of the conventional false-twisting operation, the fibrous strand is usually overfed into the false-twist zone. In contrast, the fibrous strand is somewhat underfed into the false-twist zone according to the present invention. This is because, when a fibrous strand of rather thick construction such as a roving is directly subjected to the false-twisting as in the case of the present invention, the conventional overfeed system results in insufficient impartation of twists due to lowering of the strand tension and such poor twist impartation induces frequent breakages of the strand during the processing.

Experiments were carried out by the inventors of the present invention for determination of the optimum strand feed rates into the false-twisting zone and the results so obtained are shown in Table 1 below, the feed rate being given in the form of the ratio of the surface speed $V_F$ of the feed rollers to the surface speed $V_D$ of the delivery rollers of the false twist zone.

Table 1

| Feed ratio | Strand breakage per 1000 spindles per hour |
|---|---|
| 1.08 | more than 500 |
| 1.06 | 320 |
| 1.05 | 280 |
| 1.03 | 265 |
| 1.01 | 261 |
| 1.00 | 57 |
| 0.98 | 31 |
| 0.95 | 29 |
| 0.90 | 31 |
| 0.88 | 40 |
| 0.86 | 103 |
| 0.85 | 211 |

From these results, it is deduced that the feed rate of the fibrous strand into the false-twisting zone in the present invention is desirably in a range from 0.88 to 1.00.

As already described, a heater of the non-contact type is used for heating of the fibrous strand in the present invention and such heater is desirably so constructed that the heater surface spacedly surrounds the running fibrous strand so that the strand is uniformly heated from the outside, i.e. a hollow heater is desirably used in the present invention. In other words, the heater surface is desirably provided in the form of a heating tunnel through the heater body, the internal wall surface of the heating tunnel forming the heater surface which spacedly encircles the fibrous strand in such a disposition so that, when the transverse cross sectional profile of the heating tunnel is considered, the path of the fibrous strand coincides substantially with the center of the profile. Some examples of the tunnel profile are shown in FIGS. 3A to 3D, i.e. the profile may be round as shown in FIG. 3A, elliptical as shown in FIG. 3B, oblong as shown in FIG. 3C or rectangular as shown in FIG. 3D. In the case where the strand vibrates due to ballooning, the profile shown in FIG. 3A is advantageous whereas, when the strand vibrates horizontally, the profiles shown in FIGS. 3B to 3D are advantageously employed. Vertically elongated modifications of the profiles shown in FIGS. 3B to 3D are desirably adopted when the strand vibrates vertically. That is, various modifications of the profile can be utilized in accordance with the processing condition of the strand during the heating operation.

In order to fix the optimum dimensions of the heating tunnel, an imaginary inscribed circle P of the tunnel profile Q is considered as shown in FIG. 4 with its center O coinciding with the designed path of the fibrous strand. The dimensions of the heating tunnel were considered in terms of the diameter of this circle P by the inventors of the present invention.

In the experiment, polyethylene-terephthalate staple fibers of 2 denier fineness and 51 mm length were used as the first component. Staple fibers of 2 denier fineness and 51 mm length made up of a copolymer composed of 80% by weight of polyethylene-terephthalate and 20% by weight of polyethylene-adipate were used as the second component. An ordinary blended roving of ⅓ grams per meter thickness was spun from 90% by weight of the first component and 10% by weight of the second component. The roving so obtained was processed through the arrangement shown in FIG. 1 under the following processing conditions.

| | |
|---|---|
| Draft ratio: | 20 |
| Spindle rotation: | $5 \times 10^4$ RPM |
| Surface speed of the front draft rollers: | 5.0 × 10 MPM |

The results obtained by changing the diameter of the circle P are shown in Table 2 below.

Table 2

| Diameter of the circle P in mm | Variation in strength * | Strand breakage per 1000 spindles per hour |
|---|---|---|
| 8 | 0.179 | 250 |
| 10 | 0.175 | 109 |
| 12 | 0.160 | 41 |
| 24 | 0.155 | 27 |
| 35 | 0.150 | 20 |
| 50 | 0.165 | 23 |
| 60 | 0.192 | 24 |
| 70 | 0.193 | 21 |

*Tensile strength X of yarns of 20 cm length was measured 200 times and the variation was calculated as follows:

$$\sqrt{\frac{\overline{X^2} - (\overline{X})^2}{\overline{X}}}$$

From this result, it was confirmed that the strand breakage increases when the diameter of the circle P becomes smaller than 10 mm. This is considered to be caused by the accidental contact of the running fibrous strand with the heating tunnel internal wall. Further, there is a considerable increase in the variation in the yarn tensile strength when the diameter of the circle exceeds 50 mm. This is considered to be caused by the poor heating effect of the heating tunnel wall which is too far from the running fibrous strand. From this analysis, it is considered that the diameter of the circle P lies desirably in a range from 12 to 50 mm.

As already described the heater used in the present invention is desirably provided with a heating tunnel whose internal wall spacedly encircles the fibrous strand passing therethrough. However, from the viewpoint of the yarn (fibrous strand) handling by the operators during the process, it is desirable that the heater is provided with a longitudinal slit which communicates the interior of the heating tunnel with the outside. If the heater is provided with such a longitudinal slit, the yarn can be easily handled from the outside by the operators at the time of a malfunction such as a yarn breakage. However, when considered from the viewpoint of the heating effect of the heater, it is desirable that the dimensions of such a longitudinal slit should be minimized as far as possible in order to prevent the possible invasion of the external atmosphere.

So as to fix the optimum dimension of the longitudinal slit, the imaginary inscribed circle P used in relation to the tunnel profile Q (see FIG. 4) is used also, reference being made to FIG. 5. In the illustrated structure, the heater is provided with a longitudinal slit 18 on one side thereof. An included angle $\theta$ between lines connecting the upper and lower fringes 18*a*, 18*b* of the slit 18 with the yarn path R is considered as an index of the slit dimension and is hereinafter referred to as "the slit center angle".

Experiments similar to that employed in the determination of the optimum heating tunnel dimensions were carried out by the inventors of the present invention, wherein the diameter of the circle was selected at 20 mm and the value of the slit center angle $\theta$ was varied.

The experimental results so obtained are shown in Table 3 below. It is widely known to persons skilled in the art that, in the actual use of the yarns, the employable value of the variation in the yarn strength should be 0.17 or smaller. From this point of view, it is concluded that the adoptable value of the slit center angle $\theta$ is 90° or less.

Table 3

| Slit center angle $\theta$ in degrees | Variation in strength* |
|---|---|
| 180 | 0.230 |
| 150 | 0.232 |
| 120 | 0.210 |
| 90 | 0.160 |
| 60 | 0.153 |
| 30 | 0.155 |

*See Table 2.

As already explained, vibration of the fibrous strand in the present invention is most simply realized by making use of the ballooning thereof caused by the false-twisting action. In this case, ballooning of the strand generates a vortex pneumatic flow within the heating tunnel resulting in a uniform heating effect on the fibrous strand. Further, due to the centrifugal force of the ballooning, the air contained in the core part of the strand configuration is forced out therefrom resulting in increased binding of fibers by melt fusing. In this connection, the influence of the ballooning diameter on the yarn strength and the yarn breakage was experimentally confirmed by the inventors of the present invention. The experiment was conducted in the same manner as that in the determination of the heating tunnel dimensions. The diameter of the circle P was selected at 40 mm and the heating temperature was 225°C. The results so obtained are shown in Table 4 below.

Table 4

| Ballooning diameter in mm | Yarn strength in gr. | Yarn breakage per 1000 spindles per hour |
|---|---|---|
| 0.5 | 135 | 201 |
| 1.0 | 150 | 167 |
| 2.0 | 332 | 40 |
| 3.0 | 391 | 37 |
| 5.0 | 412 | 25 |
| 10.0 | 405 | 34 |
| 15.0 | 397 | 41 |
| 20.0 | 409 | 47 |
| 25.0 | 380 | 90 |
| 30.0 | 340 | more than 200 |

As is clear from these results, no rich thermal binding effect can be expected when the ballooning diameter is below 1 mm whereas an increase in the yarn breakage is observed when the diameter exceeds 20 mm. Further, when we consider the fact that the actually acceptable yarn strength, which is the product of the yarn count and the single yarn strength, should be larger than 8000 gr and the fact that the industrially allowable yarn breakages should be less than 50, it is considered that the desirable employable ballooning diameter is in a range of from 2 to 20 mm.

A Method for obtaining the ballooning diameter in the above-determined range will hereinafter be described in detail. For this purpose, a series of experiments were conducted by the inventors of the present invention and the results obtained thereby are shown in Table 5 below.

Table 5

| Material | Case No. | Yarn count | Void* ratio | Twists in TPM | Feed ratio | Spinning speed MPM | Ballooning diameter in mm |
|---|---|---|---|---|---|---|---|
| Tetron staple (2 d × 51) Copolymerized Tetron staple (2 d × 51 mm) Blend ratio = 10% | 1 | 1/48 | 0.35 | 900 | 0.95 | 51 | 5.1 |
| Tetron staple (3 d × 89 mm) Copolymerized Tetron staple (3 d × 89 mm) Blend ratio = 15% | 2 | 1/36 | 0.36 | 705 | 0.96 | 63 | 8.1 |
| ditto | 3 | 1/30 | 0.41 | 601 | 0.98 | 20 | 10.3 |
| ditto | 4 | 1/20 | 0.45 | 705 | 1.02 | 35 | 20.2 |
| Tetron staple (1.5 d × 44 mm) Copolymerized Tetron staple (1.5 d × 44 mm) Blend ratio = 15% | 5 | 1/72 | 0.29 | 1203 | 0.89 | 58 | 1.8 |

This value was obtained in the following manner;

$$1 - \frac{nd}{D}$$

D; Apparent cross sectional area of the yarn.
n; Number of fibers per the area.
d; Average cross sectional area of individual fibers.

From this analysis, it was confirmed that the desirable ballooning diameter can be obtained when the twist is in a range from $50\sqrt{N}$ to $150\sqrt{N}$ (N; metric system count), the feed ratio is in a range from 0.88 to 1.00 and the void ratio is in a range from 0.15 to 0.50.

The following examples are illustrative of the present invention, but are not to be construed as limiting same.

EXAMPLE 1

Polyethylene-terephthalate staple fibers of 2 denier fineness and 51 mm length were prepared (the first component). Staple fibers of 2 denier fineness and 51 mm length were prepared from a copolymer composed of 80% by weight of polyethylene-terephthalate and 20% by weight of polyethyleneadipate (the second component). A blended roving was produced from 90% by weight of the first component fibers and 10% by weight of the second component fibers. This roving was processed through the arrangement shown in FIG. 1, wherein the draft ratio was 20, the diameter of the circle P was 20 mm, the length of the heater was 150 cm, the heater was heated at the temperature of 221°C and the remaining conditions were adjusted as in case No. 1 in Table 5. From the process so conducted, the following meritorious features were observed by the inventors regarding the art of the present invention.

1. The yarn so produced possessed desirable bulkiness and stretchability, each componental fibers having coil-shaped crimps.

2. Despite its substantially non-twisted configuration, the yarn so produced possessed sufficient strength.
3. The fibrous strand could be processed at very high processing speed.
4. There was no need to positively recollect the solvents.
5. The yarn so produced was provided with a spun yarn like hand, resulting in the production of fabrics therefrom having a soft hand, crisp touch and a strong resistance against pill formation.

A more detailed explanation will hereinafter be made as to the above-recited meritorious feature (5) of the art of the present invention.

As a measure for enhancing the resistance of the fabric against pill formation, it is conventional to bind componental fibers of the yarn by melting some of the componental fibers. However, when the internal configuration of the yarn is almost full of the molten substance, the resultant hand and touch of the fabrics made up of such yarns are unsuitable for wearing use. In order to obviate such trouble, the technique was developed of binding componental fibers to each other at points uniformly scattered within the yarn configuration by thermal melting of some componental fibers, i.e. to build uniformly scattered points of inter-fiber binding by thermal melting of some componental fibers in the yarn configuration. However, in the case of the conventional processes of this sort, the polymeric orientation of the fibers tends to be badly disturbed by the thermal melting phenomenon resulting in considerable lowering of the yarn strength.

From this analysis of the conventional techniques, the inventors of the present invention have confirmed that, in order to obtain the yarns accompanied with the above-described meritorious feature (5), the yarn must be of a substantially twistless configuration and the componental fibers must be melt fused to each other to a prescribed extent. In this connection, the inventors have used a value L called the "melt-fusion index" as a measure for designating the extent of the thermal fusion of the fibers composing the yarn. It was confirmed by the inventors of the present invention that the melt-fusion index should desirably be in a range from 0.02 to 0.40.

Determination of the value of this melt-fusion index L is carried out in the following manner.

The specimen is immersed in a mixed solution of paraffin and ethylene cellulose. After solidification of the paraffin, extremely thin laminae are formed by slicing the solidified body in a direction perpendicular to the longitudinal direction of the specimen yarn. By using an optical microscope, the number NM of the fibers in the cross section is counted. In this case, when two or more fibers are melt-fused together forming a single continuous body, the body is counted as a fiber. Further, the converted cross sectional area is designated as St and the average cross sectional area of a fiber before melt fusion is designated as So. The converted cross sectional area St is equal to SM × P/Po, where P is the mean tensile strength of the yarn. This is the mean value of 50 measurements taken on an Instron tensile tester with a test length of 0.5 cm and an elongation rate of 0.5 cm/min. Po is the mean tensile strength of the yarn obtained in a similar way but after melt fusion. Using the above-defined values, the melt-fusion index L is calculated as follows;

$$L = 1 - NMSo/ST$$

It will be understood that the value ST/So corresponds to the number of fibers per cross section if no amalgamation by melt fusion takes place. When there is no actual melt fusion, NM is nearly equal to ST/So and, accordingly, L is nearly equal to zero.

The value of the melt fusion index L is greatly influenced by the processing conditions in the production of the yarn. For example, when the percent blend of the fibers of the lower melting point temperature is 18, the heating time is 30 minutes and the heating is carried out at a temperature higher by 10°C than the melting point temperature of the fibers of the lower melting point temperature, the resultant value of L is 0.51. The fabrics made up of yarns of such melt-fusion index possess undesirable hand and touch. When the heating is carried out at temperatures near the melting point of the major componental fibers, the resultant value of L is in most cases 0.02 or smaller and the produced fabrics possesses very poor hand and touch. A similar result is obtained when the percent blend of the fibers of the lower melting point temperature is 2 or less.

EXAMPLE 2

Polyethylene-terephthalate staple fibers of 2 denier fineness and 51 mm length were prepared (the first component). Staple fibers of 2 denier and 51 mm length were prepared from a copolymer of 212°C melting point temperature composed of polyethylene-terephthalate and 20 mol % of isophthalic acid (the second component). Further, rayon staple fibers of 2 denier fineness and 51 mm length were prepared (the third component). The three components were blended in a ratio of 5 : 4 : 1 so as to produce a roving of 77 grain thickness on the usual spinning system. The roving so prepared was processed through the arrangement shown in FIG. 1, wherein the draft ratio was 18, the number of the false twists was 800 TPM, the heating temperature was 230°C and the take-up speed was 20 MPM. The resultant value of L of the yarn so produced was 0.045 and a woven fabric of 70 × 68 densities made thereof had desirable hand, excellent crispness and enhanced resistance against pill formation (Grade 4, ICI-method 10 Hr).

EXAMPLE 3

Polyethylene-terephthalate staple fibers of 2 denier fineness and 51 mm length were prepared (the first component). Staple fibers of 2 denier fineness and 51 mm length were prepared from a copolymer of 234°C m.p. temperature composed of 10 mol % of isophthalic acid and polyethylene-terephthalate (the second component). A common type of sliver having a thickness of ½ gram per meter was produced from 15 parts by weight of the first component and 1 part by weight of the second component. Separately from this, a polyethylene-terephthalate multifilamentary yarn of 75 denier containing 36 filaments was prepared. The sliver and the multifilamentary yarn so prepared were processed in the arrangement shown in FIG. 2, wherein the draft ratio was 26, the number of the false twists was 620 TPM, the heater was kept at 240°C, the length of the heating zone was 1.2 m and the yarn take-up speed was 152 MPM.

The yarn so produced possessed soft hand and good crispness, with a melt-fusion index L of 0.06. A plain knitted fabric thereof had a desirable hand and enhanced resistance against pill formation (Grade 4, ICI-method 5 Hr).

EXAMPLE 4

A worsted roving of ⅓ gram per meter was prepared from acrylic staple fibers of 3 d fineness and 89 mm length. Separately from this, a nylon 6 multifilamentary yarn of 20 denier containing 10 filaments was doubled with a multifilamentary yarn of 20 denier containing 7 filaments, the latter being made up of a copolymer composed of 70% of nylon 6 and 30% of nylon 12. Both the roving and the doubled multifilamentary yarn were processed in the arrangement shown in FIG. 2 wherein the draft ratio was 20, the false-twisting spindle was rotated at a speed of 131,000 RPM, the diameter of the circle P of the heater was 18 mm, the heating temperature was 150°C and the yarn processing speed was 98 MPM. The yarn so produced had excellent hand with a melt-fusion index of 0.25.

EXAMPLE 5

Side-by-side type composite staple fibers of 3 denier fineness and 76 mm length were prepared from polyethylene-terephthalate and a polyethylene-terephthalate copolymer containing 10 mol % of isophthalic acid (the first component). Polyethylene-terephthalate staple fibers of 3 denier fineness and 76 mm length were prepared also (the second component). A sliver of ½ gram per meter thickness was produced from 3 parts by weight of the first component and 1 part by weight of the second component. The sliver so produced was processed in the arrangement shown in FIG. 1 under conditions the same as those in Example 1. A woven fabric was produced from the yarns so produced, the value of L being 0.37. The fabric had a soft hand and rich crispness, with a resistance against pill formation of Grade 5 (ICI-method 10 Hr).

The number of the false twists to be imparted to the fibrous strand in the present invention must be suitably selected in consideration of the bulkiness and/or stretchability required for the yarn produced, thickness and composition of the fibrous strand to be processed and content of the fibers of low m.p. temperature. The smaller the number of the false twists, the poorer the bulkiness and the stretchability. Use of a thermoplastic filamentary yarn in combination with optimum number of the false twists results in a yarn having excellent stretchability and recovery from torque. In the case where non-thermoplastic filamentary yarns or yarns already thermally treated at temperatures higher than the false-twisting temperature are used, yarns having poor stretchability but rich bulkiness are obtainable. Further, in the system shown in FIG. 2, the sliver 13 may be supplied in an intermittent mode.

In case the fibrous strand to be processed is composed of short fibers only, it is desirable that, in the arrangement shown in FIG. 1, the distance between the untwisting point and the nip by the take-up rollers 8 is shorter than the average length of the fibers composing the fibrous strand.

A process for producing knitted or woven fabrics from the yarn produced according to the present invention will hereinafter be briefly described.

Blending of the material fibers must be carefully designed in consideration of the treatments to be applied to the fabric in the later production stages. For example, when polyamide fibers of different melting point temperatures are blended together and the fabric is treated later on with solvents of phenol type, all fibers composing the fabric are melted away by the treatment.

EXAMPLE 6

Polyethylene-terephthalate staple fibers of 3 denier fineness and 89 mm length were prepared (the first component). Staple fibers of 2 denier fineness and 89 mm length were prepared from a copolymer containing 80% of polyethylene-terephthalate and 20% of polyethylene-iso-phthalate (the second component). A worsted roving of ⅓ gram per meter thickness was prepared from 95% by weight of the first component and 5% by weight of the second component. The roving so prepared was processed in the arrangement shown in FIG. 1, wherein the draft ratio was 20. After steaming the yarns so obtained at 100°C for 20 minutes, the yarn so prepared were woven into a fabric of 92 × 85 densities. After setting in a grey state, the fabric was treated in a dioxane bath at 90°C for 20 minutes so as to remove the low m.p. temperature component by melting. The fabric so obtained possessed a velvet-like soft hand, bulkiness, resiliency and an elegant touch.

EXAMPLE 7

Spun yarns obtained in Example 6 were doubled together, provided with twist of 200 TPM in the direction opposite to the false twisting direction and treated by pressured steam at 105°C for setting. A fabric woven from the yarns so prepared was treated in a water solution of formic acid at 40°C for 20 minutes for removal of poly-ε-caprolactam. The fabric so obtained had a wool-like hand, comfortable touch, softness and resilience.

EXAMPLE 8

Polyethylene staple fibers of 3 denier fineness and 89 mm length were prepared (the first component). Polyethylene staple fibers of 3 denier fineness and 87 mm length having the m.p. temperature of 220°C were prepared from a copolymer containing 20 parts of polyethylene-iso-phthalate and 8 parts of polyethylene-terephthalate (the second component). A worsted roving ⅓ gram per meter thickness was prepared from 93% of the first component and 7% of the second component. Separately from this, a polyester multifilamentary yarn of 40 denier thickness containing 24 filaments was prepared.

They were both processed in an arrangement substantially equal to that shown in FIG. 2. But in this case, only the roving was drafted at a draft ratio of 25 and the multifilamentary yarn was amalgamated with the roving at a position just upstream of the front rollers of the draft zone. The false-twisting spindle was rotated at a speed of 140,000 RPM, the strand was fed at a speed of 152 MPM, the temperature of the heater was 235°C and the heating zone was 1.2 m long. A double jersey fabric, which was made of yarns so prepared, was treated in the dioxane bath at 80°C for 20 min for removal of the low m.p. temperature component. The fabric so produced possessed desirable bulkiness, softness, uniform loop structure and an elogant touch and appearance.

The substantially twistless configuration of the yarn manufactured according to the present invention is desirably utilized in the production of pile fabrics which possess excellent covering effect and resilience against compression. In accordance with the requirement of the end use, only the point portion of the piles may be removed by melting in the later treatment of the pile fabrics. This removal may also be performed by mechanically shearing the point portions of the piles.

EXAMPLE 9

Polyacrylonitrile staple fibers of 10 denier fineness and 76 mm length were prepared (the first component). Staple fibers of 7 denier fineness and 76 mm length were prepared from a copolymer containing 45 mol % of nylon 6, 10 mol % of nylon 66 and 45 mol % of nylon 12 (the second component). A worsted roving of 4 g/m thickness was prepared from 95% by weight of the first component and 5% by weight of the second component.

The roving so prepared was processed in the arrangement shown in FIG. 1, wherein the draft ratio was 20, the spindle was rotated at 4400 RPM, the heater was kept at 180°C, the heating zone was 1.5 m long and the strand was fed to the heater at a speed of 20 MPM.

Three substantially twistless yarns so produced were doubled together and twisted at 120 TPM and a fabric of the yarns so twisted was produced. Tufting was applied to the fabric on a tufting machine of 5/32 gauge and 9 stitches per 1 inch so as to develop piles of 7 mm height. The tufted fabric was coated on its reverse side with ordinary latex and, after drying, treated in a 70% formic acid bath for 10 min. for removal of the low m.p. temperature component. The velvet thus obtained had a good covering effect and resilience against compression.

It is also possible in the present invention for a third component to be added to the composition of the material fibrous strand. For example, the material fibrous strand may be composed of the first component A, the second component B which melts at temperatures whereat the first component A is not melted, and the third component C which melts at temperatures whereat the first component A does not melt and is dissolved by a solvent which does not fully melt the first and second components A, B. In this case, the strand is heated firstly so as to cause the melting of the second component B and melting of at least some of the third component C. Secondly, in the fabric state, the third component C is at least partly removed from the fabric by treatment with the above-mentioned solvent. By the presence of the third component C, the yarn is provided with a strongly bound configuration during the processes preceding the removal of same and, after the removal of same by dissolution, the end product fabric possesses desirable hand and crispness.

EXAMPLE 10

Polyethylene-terephthalate staple fibers of 3 denier fineness and 89 mm length were prepared (the first component). Staple fibers of 3 denier fineness and 89 mm length were prepared by blend spinning of 9 parts of polyethylene-terephthalate with 1 part of polyethylene-glycol (the second component). Polyethylene-sebacate staple fibers of 3 denier fineness and 89 mm length were prepared also (the third component). A worsted roving of ½ gram per meter thickness was prepared from 65% by weight of the first component, 15% by weight of the second component and 20% by weight of the third component. The roving so prepared was processed in the arrangement shown in FIG. 1, wherein the draft ratio was 15, the spindle was rotated at 45,000 RPM, the heater was kept at 235°C and the yarn processing speed was 28 MPM. The yarn so produced had a strength of 2.5 gram per denier. A plain fabric of 55 × 50 densities was woven using the yarns. This fabric was treated in a 5% NaOH bath at 98°C for 1 hr. The resultant fabric had an elegant luster, soft hand and bulkiness.

What we claim is:

1. A process for producing spun-like yarns by a false-twisting system, comprising, in combination, forming a fibrous strand from at least two kinds of fibers having different melting point temperatures, said fibrous strand containing at least some short fibers, subjecting said strand simultaneously to false-twisting and ballooning vibration with the balloon having a diameter of two to twenty millimeters whereby a twisting zone is created, and heating said strand in said twisting zone to temperatures between the highest and lowest melting point temperatures of said fibers without directly contacting said strand with any heating element, and keeping said strand to reach a temperature above the lowest melting point of said fibers while said strand is in said twisting zone.

2. Process as claimed in claim 1 wherein said fibrous strand is underfed into the false-twisting zone.

3. Process as claimed in claim 1 wherein the strand is underfed to said false-twisting zone by an amount in the range of 0 to 12%.

4. A process as claimed in claim 1 wherein the number of the false-twists per meter is in a range from 50 $\sqrt{N}$ to 150 $\sqrt{N}$, N being the metric system count of the yarn to be produced.

* * * * *